US010240292B2

(12) United States Patent
Hassman et al.

(10) Patent No.: US 10,240,292 B2
(45) Date of Patent: Mar. 26, 2019

(54) THROUGH-AIR DRYING APPARATUS AND METHODS OF MANUFACTURE

(71) Applicant: Kimberly-Clark Worldwide, Inc., Neenah, WI (US)

(72) Inventors: Mark John Hassman, Oshkosh, WI (US); Peter John Allen, Neenah, WI (US); Frank Stephen Hada, Appleton, WI (US); Robert James Seymour, Appleton, WI (US); Richard Allen Zanon, Appleton, WI (US); Richard Mark Hansen, Oshkosh, WI (US); Nathan John Haiduk, Appleton, WI (US); Samuel August Nelson, Menasha, WI (US); Daniel Robert Sprangers, Kaukauna, WI (US); Paul Timothy Baker, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/060,387

(22) PCT Filed: Feb. 29, 2016

(86) PCT No.: PCT/US2016/020084
§ 371 (c)(1),
(2) Date: Jun. 7, 2018

(87) PCT Pub. No.: WO2017/151096
PCT Pub. Date: Sep. 8, 2017

(65) Prior Publication Data
US 2018/0363243 A1 Dec. 20, 2018

(51) Int. Cl.
*D21F 5/18* (2006.01)
*D21H 27/30* (2006.01)
(Continued)

(52) U.S. Cl.
CPC ..... *D21F 5/182* (2013.01); *D21F 5/044* (2013.01); *D21H 27/007* (2013.01); *D21H 27/30* (2013.01)

(58) Field of Classification Search
CPC ..... D21F 5/182; D21F 5/044; D21H 27/007; D21H 27/30
(Continued)

(56) References Cited

U.S. PATENT DOCUMENTS 4,172,910 A 10/1979 Rotar
4,251,928 A 2/1981 Rotar
(Continued)

FOREIGN PATENT DOCUMENTS

AT 403385 B * 1/1998 ..... D21F 5/042
CA 2452031 A1 * 2/2003 ..... D21F 5/181
(Continued)

*Primary Examiner* — Stephen M Gravini
(74) *Attorney, Agent, or Firm* — Kimberly-Clark Worldwide, Inc.

(57) ABSTRACT

Unlike conventional through-air drying processes the instant invention utilizes at least two through-air driers where the first dyer is at least partially encircled by a first through-air drying fabric and the second dyer is at least partially encircled by a second through-air drying fabric. By providing each through-air dryer with its own fabric the overall drying performance may be increased. Additionally, in certain embodiments, the first and second fabrics may be different to optimize both the drying performance and/or tissue product properties.

22 Claims, 2 Drawing Sheets

(51) Int. Cl.
*D21F 5/04* (2006.01)
*D21H 27/00* (2006.01)

(58) Field of Classification Search
USPC ..... 34/122
See application file for complete search history.

(56) References Cited

U.S. PATENT DOCUMENTS 4,462,868 A 7/1984 Oubridge
4,481,722 A * 11/1984 Guy ..... D21F 5/182 34/115
4,528,239 A 7/1985 Trokhan
4,921,750 A 5/1990 Todd
5,020,241 A * 6/1991 Fleissner ..... D06B 5/08 34/115
5,048,589 A 9/1991 Cook
5,348,620 A 9/1994 Hermans
5,399,412 A 3/1995 Sudall
5,465,504 A 11/1995 Joiner
5,579,589 A * 12/1996 Oechsle ..... D21F 5/042 34/115
5,887,358 A * 3/1999 Bischel ..... D21F 5/046 34/115
5,933,979 A * 8/1999 Wedel ..... D21F 5/042 34/117
5,937,538 A 8/1999 Joiner
6,199,296 B1 * 3/2001 Jewitt ..... D21F 5/182 34/115
6,228,216 B1 * 5/2001 Lindsay ..... D21F 11/14 162/111
6,398,916 B1 * 6/2002 Klerelid ..... D21F 5/182 162/290
6,454,904 B1 * 9/2002 Hermans ..... D21F 1/48 162/205
6,877,246 B1 * 4/2005 Hada ..... D21F 5/182 34/119
6,904,700 B2 * 6/2005 Hada ..... D21F 5/182 34/114
7,721,464 B2 * 5/2010 Hada ..... D21F 5/182 162/307
7,905,989 B2 * 3/2011 Scherb ..... D21F 11/14 162/281
8,141,595 B2 3/2012 Quigley
8,196,314 B2 * 6/2012 Munch ..... D21F 5/02 162/115
8,383,529 B2 * 2/2013 Ono ..... B01D 39/18 162/1
8,512,515 B2 * 8/2013 Dyer ..... A61K 8/0208 162/112
8,997,371 B2 * 4/2015 Bohn ..... F26B 13/16 34/124
9,074,324 B2 * 7/2015 Shannon ..... D21H 11/04
9,243,367 B2 * 1/2016 Rekoske ..... D21H 27/002
9,696,088 B2 * 7/2017 Bohn ..... F26B 21/02
9,765,480 B2 * 9/2017 Schmit ..... D21F 5/18
10,119,757 B2 * 11/2018 Bohn ..... F26B 3/02
2003/0019601 A1 1/2003 Hermans
2005/0148261 A1 7/2005 Close
2007/0074835 A1 4/2007 Scherb
2007/0207692 A1 9/2007 Ono
2013/0299107 A1 11/2013 Shannon

FOREIGN PATENT DOCUMENTS

DE 102005046903 A1 * 4/2007 ..... D21F 11/14
EP 0743392 A3 * 2/1998 ..... D21F 5/042
EP 1769836 B1 * 10/2013 ..... B01D 39/18
EP 2065514 B1 * 5/2014 ..... D21F 5/181
WO WO 03012197 A2 * 2/2003 ..... D21F 5/181

* cited by examiner

THROUGH-AIR DRYING APPARATUS AND METHODS OF MANUFACTURE

BACKGROUND OF THE DISCLOSURE

In the manufacture of tissue webs, a slurry of cellulosic fibers is deposited onto a forming wire to form a wet embryonic web. The resulting wet embryonic web may be dried by any one of or combinations of known means, where each drying means may potentially affect the properties of the resulting tissue web. For example, the drying means may affect the softness, caliper, tensile strength, and absorbency of the resulting cellulosic tissue web.

An example of one drying means is through-air drying. In a typical through-air drying process, a foraminous air permeable fabric supports the embryonic web to be dried. Hot air flow passes through the web, then through the permeable fabric or vice versa. The air flow principally dries the embryonic web by evaporation. Regions coincident with and deflected into fabric voids are preferentially dried. Regions of the web coincident with solid regions of the fabric, such as woven knuckles, are dried to a lesser extent by the airflow as the air cannot pass through the fabric in these regions.

To improve the efficiency and effectiveness of through-air drying several improvements to through-air drying fabrics have been made. For example, the in certain instances the air permeability of the fabric has been increased by manufacturing the fabric with a high degree of open area. In other instances fabrics have been impregnated with metallic particles to increase their thermal conductivity and reduce their emissivity. In still other instances the fabric itself has been manufactured from materials specially adapted for high temperature airflows. Examples of such through-air drying technology are found, for example, in U.S. Pat. Nos. 4,172,910, 4,251,928, 4,528,239 and 4,921,750.

While the foregoing fabric improvements have resulted in certain beneficial gains, they have not yet successfully addressed problems associated with through-air drying non-uniform tissue webs. For example, a tissue web having a first region with lesser absolute moisture, density or basis weight than a second region, will typically have relatively greater airflow through the first region compared to the second. This relatively greater airflow occurs because the first region of lesser absolute moisture, density or basis weight presents a proportionately lesser flow resistance to the air passing through such region. As a result the first and second regions dry at different rates and may ultimately result in a web having variable moisture content and/or physical properties.

The difficulties of drying non-uniform webs is exacerbated by the fact that through-air drying relies upon a fabric to support the tissue web throughout the drying process. Because airflow directed towards the web is transferred through the supporting fabric during manufacture, the fabric itself creates differences in flow resistance through the tissue web. The difference in air flow caused by the fabric can amplify differences in moisture distribution within the tissue web, and/or create differences in moisture distribution where none previously existed.

Thus, there remains a need in the art for more efficient through-air drying apparatus, particularly one that can accommodate non-uniform tissue webs and the use of fabrics having varying degrees of air permeability.

SUMMARY OF THE DISCLOSURE

Unlike conventional tissue making processes the instant invention utilizes at least two noncompressive dewatering devices, such as two through-air driers, where the first device is at least partially encircled by a first fabric and the second device is at least partially encircled by a second fabric. By providing the each dewatering device with its own fabric the overall drying performance may be increased. Additionally, in certain embodiments, the first and second fabrics may be different to optimize both the dewatering performance and/or tissue product properties. For example, in one embodiment the first fabric may be designed to optimize molding of the embryonic tissue web, improving cross-machine (CD) tissue product properties such as CD stretch and CD tensile energy absorption (TEA), while the second fabric may be designed to optimize drying efficiency. In this manner the overall dewatering performance may be improved and at the same time the resulting tissue product products may be improved.

Accordingly, in one embodiment the present invention provides a method of manufacturing a tissue web comprising the steps of depositing an aqueous furnish comprising cellulosic fiber on a foraminous support to form a wet tissue web; transferring the wet tissue web to a first fabric and noncompressively dewatering the wet web to a consistency of from about 40 to about 80 percent; transferring the dewatered web to a second fabric and noncompressively dewatering the dewatered web to a consistency from about 60 to about 100 percent.

In another embodiment the present invention provides a through-air drying apparatus useful in the manufacture of tissue web, the apparatus comprising a first and a second through-air dryer where each through-air dryer is encircled by a separate through-air drying fabric. In this manner the invention provides a through-air drying apparatus which reduces the necessary residence time of the embryonic web thereon and/or requires less energy than had previously been thought in the prior art to dry the web to a final dryness. Further, by providing a separate fabric for each through-air dryer an apparatus having at least two drying zones is provided where each drying zone may be specifically adapted to maximize the efficiency of tissue web manufacture and/or maximize tissue web physical properties.

In still another embodiment the present invention provides a method of through-air drying a tissue web comprising the steps of transferring a wet tissue web to a first through-air drying fabric; through-air drying the wet tissue web to form a partially dewatered tissue web; transferring the partially dried tissue web to a second through-air drying fabric; and through-air drying the partially dewatered tissue web, wherein the first and the second through-air drying fabrics are different.

In yet another embodiment the invention provides a method of through-air drying a tissue web comprising the steps of transferring a wet tissue web to a first through-air drying fabric; through-air drying the wet tissue web at a first temperature to form a partially dewatered tissue web; transferring the partially dried tissue web to a second through-air drying fabric; and through-air drying the partially dewatered tissue web at a second temperature, wherein the second temperature is greater than the first temperature.

In another embodiment the invention provides a method of through-air drying a tissue web comprising the steps of transferring a wet tissue web to a first through-air drying fabric having a three dimensional topography; through-air drying the wet tissue web to form a partially dewatered tissue web; transferring the partially dried tissue web to a substantially planar through-air drying fabric; and through-air drying the partially dewatered tissue web.

In still another embodiment the invention provides a method of through-air drying a tissue web comprising the steps of transferring a wet tissue web to a first through-air drying fabric having a substantially MD oriented line element; through-air drying the wet tissue web to form a partially dewatered tissue web; transferring the partially dried tissue web to a second through-air drying fabric having a substantially MD oriented line element; and through-air drying the partially dewatered tissue web, wherein the line element of the first fabric is not aligned with the line element of the second fabric.

DEFINITIONS

Figure 1:
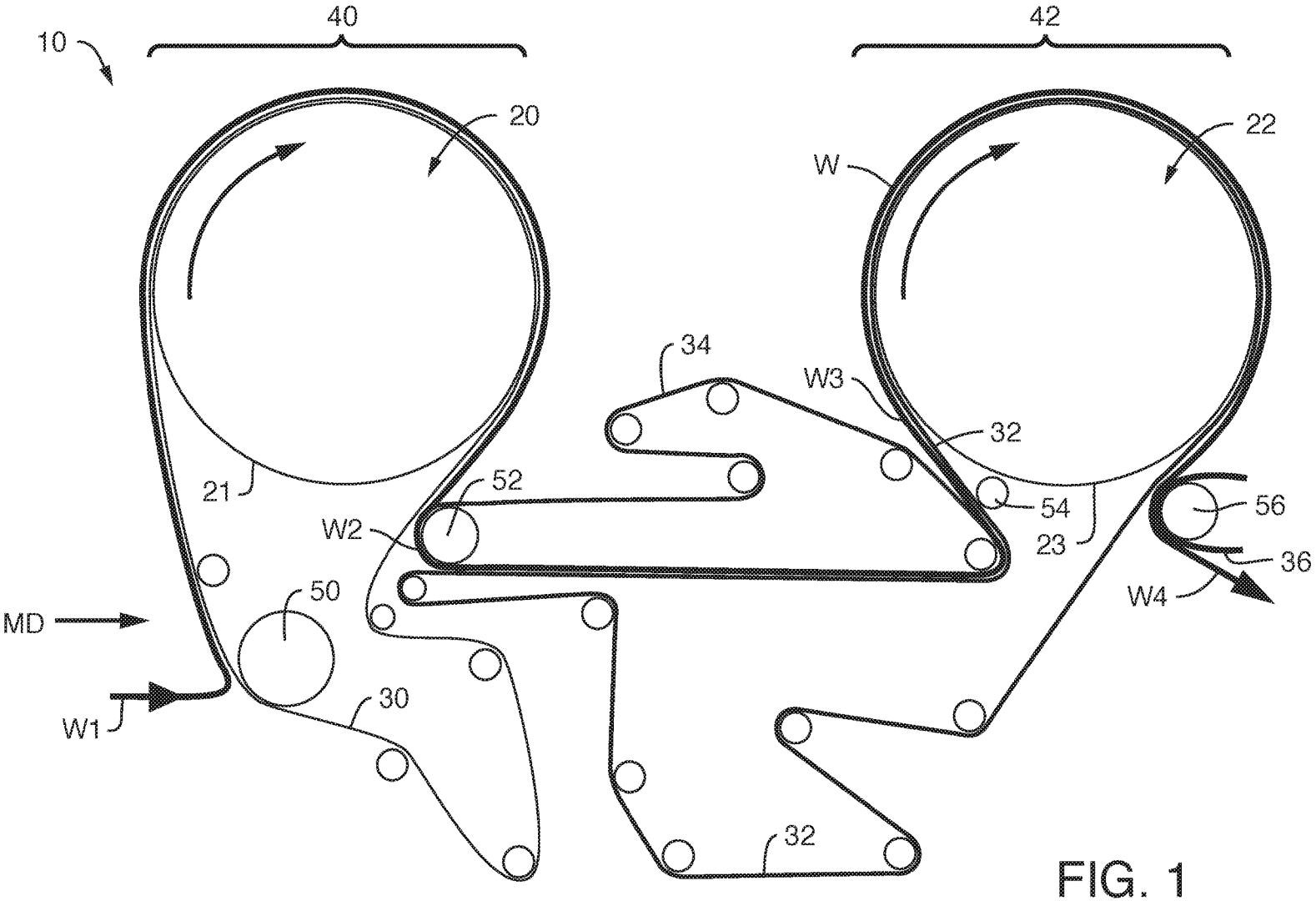
FIG. 1 is a schematic view of a through-air drying apparatus according to one embodiment of the present invention.

As used herein the term "Air Permeability" refers to the relative amount of air that may pass through a papermaking fabric. Air permeability may be measured with the FX 3300 Air Permeability device manufactured by Textest AG (Zürich, Switzerland), set to a pressure of 125 Pa with the normal 7-cm diameter opening (38 square centimeters area), which gives readings of Air Permeability in cubic feet per minute (CFM) that are comparable to well-known Frazier Air Permeability measurements. The Air Permeability value for the tissue making fabrics useful in the present invention may be about 30 CFM or greater, such as any of the following values (about or greater): 50 CFM, 70 CFM, 100 CFM, 150 CFM, 200 CFM, 250 CFM, 300 CFM, 350 CFM, 400 CFM, 450 CFM, 500 CFM, 550 CFM, 600 CFM, 650 CFM, 700 CFM, 750 CFM, 800 CFM, 900 CFM, 1000 CFM, and 1100 CFM. Exemplary ranges include from about 200 to about 1400 CFM, from about 300 to about 1200 CFM, and from about 100 to about 800 CFM. For some applications, low Air Permeability may be desirable. Thus, the Air Permeability of the tissue making fabric may be about 500 CFM or less, about 400 CFM or less, about 300 CFM or less, or about 200 CFM or less, such as from about 30 CFM to about 150 CFM.

As used herein the term "fabric" refers to any endless fabric or belt used for making a tissue sheet, either by a wet-laid process or an air-laid process. The fabrics useful in the present invention can be woven fabrics or non-woven fabrics.

As used herein, the term "non-woven fabric" refers to non-woven material which is in the form of a continuous loop or can be formed into a continuous loop, for example, by virtue of a seam. Non-woven fabrics, such as those comprising spiral-laminated non-woven webs, are particularly suitable for use in accordance with this invention.

As used herein the "topographical pattern" generally refers to a fabric having a three-dimensional topography with z-directional elevation differences of about 0.2 millimeter or greater, such as from about 0.2 to about 3.5 mm, more preferably from about 0.5 to about 1.5 mm, and in a particularly preferred embodiment from about 0.7 to about 1.0 mm. The topography can be regular or irregular. Suitable topographical patterns may include a fabric surface having alternating ridges and valleys or bumps and depressions. For woven fabrics, the topographical pattern may be provided by the general weave pattern. For non-woven papermaking fabrics the topographical pattern may be provided by a pattern applied to or formed into the non-woven belt. In certain embodiments the topographical pattern may texturize the surface of the tissue web during manufacture providing the surface of the tissue web with a first and a second elevation. In particularly preferred embodiments the topographical pattern may comprise a plurality of line elements, such as a plurality of line elements that are substantially oriented in the machine-machine direction of the tissue web.

As used herein the term "line element" refers to a topographical pattern in the shape of a line, which may be continuous, discrete, interrupted, and/or partial line with respect to a tissue web on which it is present. The line element may be of any suitable shape such as straight, bent, kinked, curled, curvilinear, serpentine, sinusoidal, and mixtures thereof, which may form a regular or irregular, periodic or non-periodic lattice work of structures wherein the line element exhibits a length along its path of at least 10 mm. In one example, the line element may comprise a plurality of discrete elements, such as dots and/or dashes for example, that are oriented together to form a line element.

As used herein the term "continuous element" refers to an element disposed on a carrier structure useful in forming a tissue web or a topographical pattern that extends without interruption throughout one dimension of the carrier structure or the tissue web.

As used herein the term "discrete element" refers to separate, unconnected elements disposed on a carrier structure useful in forming a tissue web or on the surface of a tissue web that do not extend continuously in any dimension of the support structure or the tissue web as the case may be.

As used herein the term "curvilinear decorative element" refers to any line or visible pattern that contains either straight sections, curved sections, or both that are substantially connected visually. Curvilinear decorative elements may appear as undulating lines, substantially connected visually, forming signatures or patterns.

As used herein the term "through-air dried" refers to a method of manufacturing a tissue web where a drying medium, such as heated air, is blown through a perforated cylinder, the embryonic tissue web and the fabric supporting the web. Generally the embryonic tissue web is supported by the fabric and is not brought into contact with the perforated cylinder.

As used herein, "noncompressive dewatering" and "noncompressive drying" refer to dewatering or drying methods, respectively, for removing water from tissue webs that do not involve compressive nips or other steps causing significant densification or compression of a portion of the web during the drying or dewatering process. In particularly preferred embodiments the wet web is wet-molded in the process of noncompressive dewatering to improve the three-dimensionality and absorbent properties of the web. As used herein, "wet-molded" tissue sheets are those which are conformed to the surface contour of a fabric while at a consistency of about 30 to about 50 percent and then further dried by through-air drying.

As used herein the term "tissue web" refers to a fibrous structure provided in sheet form and being suitable for forming a tissue product. Tissue webs manufactured according to the present invention generally have a basis weight greater than about 10 grams per square meter (gsm), such as from about 10 to about 100 gsm and more preferably from about 15 to about 60 gsm and web bulks (the inverse of density) greater than about 3 cubic centimeters per gram (cc/g), such as from about 3 to about 25 cc/g and more preferably from about 10 to about 20 cc/g.

As used herein "uncreped through-air dried" or UCTAD refers to a process of making a material, and to the material made thereby, by forming a furnish of cellulosic fibers, depositing the furnish on a traveling foraminous belt, subjecting the fibrous web to noncompressive drying to remove the water from the fibrous web, and removing the dried fibrous web from the traveling foraminous belt. Such webs are described in U.S. Pat. Nos. 5,048,589, 5,348,620 and 5,399,412.

DETAILED DESCRIPTION OF THE DISCLOSURE

The methods and apparatus of the present invention are generally well suited for the manufacture of tissue webs and particularly through-air dried tissue webs. The apparatus generally comprise two or more noncompressive dewatering means, such as through-air driers, in serial alignment with one another. For example, in certain embodiments, the present invention provides an apparatus for drying a wet tissue web comprising at least two through-air dryers (TADs), each dryer including a rotatable cylinder having a porous cylindrical deck, a first fabric wrapped about a portion of the circumference of the first through-air dryer deck, a second fabric wrapped about a portion of the circumference of the second through-air dryer deck, and plurality of web transfer devices positioned relative to each cylinder so as to direct the fabric and/or web onto and from each cylinder. Generally the fabrics partially encircling each TAD will be referred to herein collectively as TAD fabrics and individually as the first TAD fabric (encircling the most upstream TAD and the first TAD encountered by the embryonic web) and the second TAD fabric (encircling the TAD downstream from and adjacent to the first TAD).

In particularly preferred embodiments, the noncompressive dewatering means comprises a through-air dryer. Through-air dryers are generally well known in the art and any of such through-air dryers can be utilized in the present invention. For example, some suitable through-air dryers are described in U.S. Pat. Nos. 4,462,868, 5,465,504 and 5,937,538, which are incorporated herein by reference in a manner consistent with the present disclosure. Each TAD generally comprises an outer rotatable perforated cylinder and an outer hood. The hood is used to direct a heated drying medium from a drying medium supply duct and source against and through the fibrous web and fabric, as is known to those skilled in the art. The TAD fabric carries the fibrous web over the upper portion of the through-air dryer outer cylinder. The drying medium is forced through the web and fabric and through the perforations in the outer cylinder of the TAD. The drying medium removes the remaining water from the fibrous web and exits the cylinder via conduits in proximity to outlets positioned along the axis of the cylinder.

Thus, in one embodiment, the present invention provides two or more TADs each having a rotatable cylinder and a plurality of web transfer devices disposed adjacent thereto for directing the fabric and the tissue web onto and from each cylinder. The TAD may be configured to provide an inward flow of the drying medium, such as hot air or steam, wherein the drying medium is flowed from the exterior of the cylinder through the tissue web, the fabric, and the deck and into the interior of the cylinder. For an inward flow configuration, the embryonic tissue web is supported by the TAD fabric on an outer surface thereof and the fabric lies between the web and the deck as the web is transported about the TAD. For example, in an inward flow configuration such as shown in FIG. 1, the drying medium is flowed from the exterior of the cylinder 20 through the tissue web W, the fabric 30 and the deck 21 into the interior of the cylinder 20 before being exhausted.

Alternatively, the TAD may be configured in an outward flow arrangement wherein the drying medium flows from the interior of the cylinder through the deck, the TAD fabric, and the web to the exterior of the cylinder. Preferably, with an outward flow configuration, the web is supported between two fabrics as it is carried about the cylinder of the TAD. In still other embodiments the TAD may be configured in a cross flow arrangement whereby the drying medium is flowed both into and out of the interior of the cylinder through the deck.

With further reference to FIG. 1, one embodiment of an apparatus for drying a tissue web is illustrated. As is generally known in the art a wet tissue web may be formed by depositing a dilute suspension containing fibers and more preferably cellulosic fibers via a sluice onto a foraminous surface. Once deposited on the foraminous surface water is removed from the web by combinations of gravity, centrifugal force and vacuum suction depending upon the forming configuration. Once formed, the relatively wet web W1, traveling in the machine direction (MD) indicated by the arrow, may be transferred to a first TAD fabric 30 and conveyed over a portion of a first TAD 20 to dry the web. A "relatively wet" paper web is initially provided to the first dryer section 40 to be dried. As used herein, the phrase "relatively wet" generally refers to paper webs having a low solids consistency. For instance, a web may be supplied to the first dryer section at a consistency of less than about 60 percent (percent solids consistency), particularly between about 15 to about 45 percent, and more particularly between about 20 to about 40 percent.

Once deposited on the first TAD fabric 30 the web is conveyed through first dryer section 40. Generally the first dryer section comprises a TAD, a TAD fabric supported and guided by rolls and web transfer device for transferring the relatively wet web from the foraminous surface to the TAD fabric. As the web is moved through the first dryer section, it is partially dried. Within the first dryer section, however, the web is relatively wet so that very little, if any, heated air actually passes through the web. Rather, the air generally impinges on the surface of the web, and heats the web to evaporate the moisture contained thereon. After contacting the web surface, the air can then flow along with the web and/or through the web into the interior of the cylinder, where it can be exhausted.

From the first dryer section 40, the web then enters a second dryer section 42 for further drying. In general, the web W3 entering the second dryer section is "relatively dry". As used herein, the phrase "relatively dry" generally refers to paper webs having a higher solids consistency than a "relatively wet" web. For example, "relatively wet" webs having consistencies within the above-mentioned ranges can be dried to consistencies of greater than about 25 percent (percent solids consistency), particularly greater than about 35 percent, and more particularly between about 45 to about 70 percent, within the first dryer section to result in a "relatively dry" web. Although the exemplary ranges mentioned above for "relatively dry" webs and "relatively wet" webs are overlapping, such webs should generally be interpreted to have different consistencies. For instance, in some instances, a "relatively wet" web may have a consistency of about 35 percent. In such cases, a "relatively dry" web would accordingly have a consistency of greater than about 35 percent. It should also be understood that, at any given point of a continuous drying process the solids consistency of a web passing therethrough is generally greater than the solids consistency of the web at any previous point of the process.

The first and second TAD fabrics are adapted to support and transport the wet tissue web about a portion of the circumference of the cylinder of each dryer. The web transfer devices preferably include a first fabric support member located at an upstream end of the apparatus for directing the wet web and the first TAD fabric onto the cylinder of the first TAD, a second fabric support located between the first and the second TAD, and a third fabric support member located at a downstream end of the apparatus for directing the web and the fabric from the cylinder of the second TAD. The hood further interacts with at least the first and the second web transfer devices and covers the portion of each cylinder about which the fabric and the web are wrapped.

As the tissue web is conveyed through the manufacturing process it is transferred from the first TAD fabric to the second TAD fabric using a web transfer device. The web transfer device generally facilitates transfer of the web from one fabric to another or from one fabric to a cylinder and may take a variety of forms well known in the art. For example, the web transfer device may comprise a vacuum box, a rotatable roll, a transfer shoe or the like. With reference to FIG. 1 the web transfer device 52 works on the web W2 and directs it away from the first TAD fabric 30 towards an intermediate fabric 34 and comprises a suction roll 52 disposed within the loop of the fabric 34. The suction roll 52 may be adapted to use a pressure differential of between about 30 kilopascals (kPa) and about 50 kPa over the web W to retain the web W on the second TAD fabric 32.

At the web transfer device 52 the web W is separated from the first TAD fabric 30. According to a preferred embodiment of the present invention, the web W is transported between the first TAD 20 and the second TAD 22 while sandwiched between an intermediate fabric 34 and the second TAD fabric 32. Preferably the span between the first TAD 20 and the second TAD 22 is minimized and the web is exposed to little or no directional change there between or compression. Typically, if the web W is sandwiched between the intermediate fabric 34 and the second TAD fabric 32 passes about an object which causes a directional change thereof, such as a guide roll, the fabric closest to the object will tend to travel farther than the distant fabric on the opposite side of the paper web. When one fabric runs ahead of the other, internal shear stresses are formed in the web which may lead to damage thereof. Thus, most preferably, the distance traversed by the web W as it sandwiched between the intermediate fabric 34 and the second TAD fabric is kept relatively short and as straight as possible. In a preferred embodiment, the web W is transported in a substantially straight path between the web transfer device which separates the web from the first TAD fabric and the web transfer device that separates the web from the transfer fabric.

The web W3 is separated from the intermediate fabric 34 by the web transfer device 54, which is preferably configured such that the web W3 is retained on the second TAD fabric 32 and transported thereon to further downstream processes in the apparatus 10. In one embodiment of the present invention, the web transfer device 54 used to transfer the web W3 from the intermediate fabric 34 to the second TAD fabric 32 is a vacuum transfer roll lying within a loop of the second TAD fabric and at least partially supporting the TAD fabric.

The second TAD 22 comprises a downstream cylinder encircled by the second TAD fabric 32. The web W3 is transferred from the intermediate fabric 34 onto the second TAD fabric 32 and conveyed over a portion of the second TAD 22. In certain embodiments the second TAD 22 dries the web to its final dryness, such as a consistency of at least about 90 percent and more preferably at least about 95 percent, such as from about 90 to about 100 percent. In other embodiments the second TAD 22 only partially dries the web such that the web W4 has a consistency from about 60 to 80 percent and the web is subsequently conveyed along the process and dried to a final dryness.

In certain embodiments the web W4 may be removed from the downstream cylinder 22 by yet another web transfer device 56, which may transfer the web to a yet another fabric 36 which transports the web along the process until it is eventually wound into a roll. In a particularly preferred embodiment the second TAD fabric 32 carries the web W4 below a through-dryer guide roller towards a lower guide roller (not illustrated). The web W4 may then be conveyed onto a winder, such as a surface winder, and wound into a roll. In this manner, the web is an uncreped through-air dried web, which is one preferred means of manufacturing tissue webs according to the present invention.

While in one embodiment the manufacture of tissue webs using the inventive drying apparatus does not involve a creping step, the invention is not so limited. In certain embodiments the tissue web may be creped or otherwise treated after being noncompressively dewatered a second time. For example, in certain embodiments, a web having a consistency from about from about 60 to 80 percent may be transferred from a fabric encircling the downstream cylinder onto an impression fabric using a web transfer apparatus. Once the web has been transferred to the impression factor it may be pressed against the surface of another cylinder, such as a Yankee dryer, and creped therefrom to yield a dried tissue web.

Figure 2:
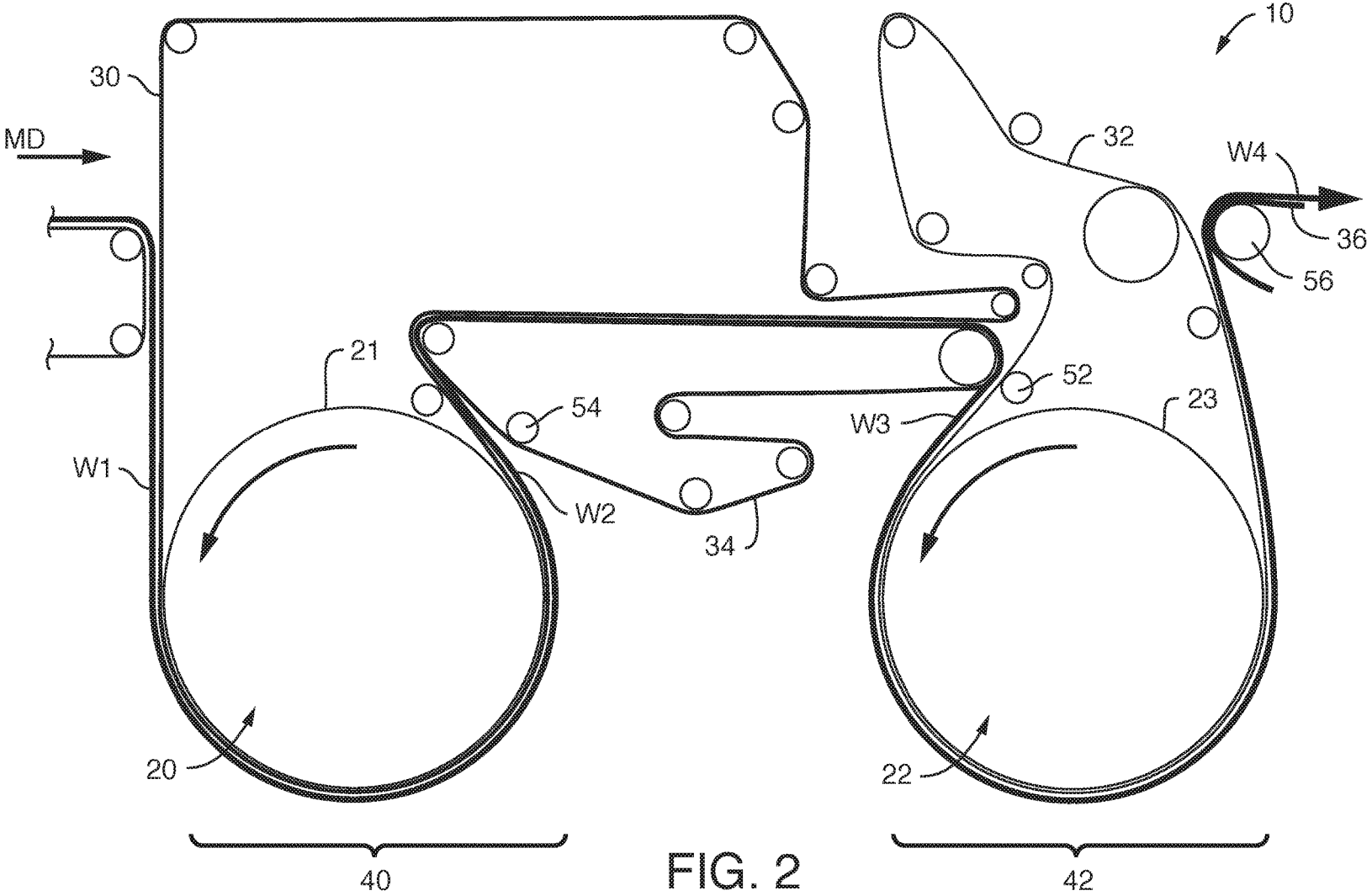
FIG. 2 is a schematic view of a through-air drying apparatus according to another embodiment of the present invention.

Further, while the drying apparatus may be configured as illustrated in FIG. 1, the invention is not so limited and alternate configurations are envisioned. For example, as illustrated in FIG. 2, the relatively wet web W1 may be transferred to the first TAD fabric 30 at a point above the first TAD 20 and be conveyed downward towards the first TAD 20. From the first TAD fabric 30 the partially dried web W2 may be sandwiched between the first TAD fabric 30 and the intermediate fabric 34 before being transferred to the second TAD fabric 32.

Accordingly, the invention is not limited by the processing steps occurring after the web is conveyed across the second noncompressive dewatering device. Rather, the present invention resides in at least two noncompressive dewatering devices each being provided with a separate fabric. The use of separate fabrics to convey the web over the non-compressive dewatering means enables the use of different drying conditions through the drying process. For example, the temperature of the drying medium, such as heated air, within the first dryer section 40 and the second dryer section 42 can be selectively controlled to improve the overall capacity of the drying apparatus 10. In particular, a lower temperature can be provided to the first dryer section 40 when the web is relatively wet and an elevated temperature can be provided to the second dryer section 40 when the web is relatively dry. For instance, in one embodiment, a temperature between about 300° F. to about 400° F., and particularly between about 300° F. to about 350° F., is provided to the first dryer section 40, while a temperature between about 400° F. to about 500° F., and particularly between about 450° F. to about 500° F., is provided to the second dryer section 40. In other embodiments temperature of the drying medium provided to the second drying section may be at least about 5 percent greater than the temperature of the drying medium provided to the first drying section and still more preferably at least about 10 percent greater, such as from about 5 to about 20 percent greater.

By providing the dryer sections with two different drying medium temperatures the drying and performance of each of the drying sections may be optimized and the overall drying efficiency may be improved. Improved drying efficiency allows the web to be fed at a greater speed to the dryer to increase the overall rate of production of tissue webs (i.e., production capacity). Moreover, it has also been discovered that the provision of such lower temperatures to the first dryer section generally does not cause the first TAD fabric to be heated significantly above its thermal degradation temperature and may extend the useful life of the first TAD fabric. Additionally, as will be discussed in more detail below, the use of two different temperatures may further enable the use of distinctly different first and second TAD fabrics. For example the first TAD fabric may have low permeability and a high degree of topography to achieve a high degree of sheet molding at relatively low dryer temperatures, while the second fabric may have little or no topography and a high degree of permeability to achieve a high degree of water removal at a higher dryer temperature.

In general, the temperature supplied to the first dryer section and the second dryer section can be controlled using a variety of methods and/or techniques. For instance, in one embodiment, as shown two burners (not shown) can be used in conjunction with two separate air supply channels. In this manner, the temperature of the air supplied to the first TAD can be controlled independently from the temperature of the air supplied to the second TAD such that the temperature within the first dryer section 40 is relatively constant and the elevated temperature within the second dryer section 40 is relatively constant.

An additional benefit of the present invention is that by providing separate fabrics for each individual drying apparatus the fabrics themselves may be selected to optimize drying efficiency or product performance. For example, in the embodiment illustrated in FIG. 1, the first TAD 20 is provided with a first TAD fabric 30 and the second TAD 22 is provided with a second TAD fabric 32. The first and second TAD fabrics 30, 32 may be different or they may be the same. For instance, in one embodiment, an embryonic tissue web is molded to a first through-air drying (TAD) fabric having a topographic pattern and partially dried by a first TAD. The molded and partially dried web is then transferred to a second TAD fabric that is different than the first TAD fabric and further dried by a second TAD.

In a particularly preferred embodiment the difference between the first and second TAD fabrics resides in the degree of surface topography. For example, in one embodiment, the first TAD fabric has a topographical pattern and the second TAD fabric is substantially smooth. In other embodiments the difference between the first and the second TAD fabrics is the degree of permeability. For example, the first TAD fabric has a lower air permeability than the second TAD. These and other embodiments will be described in more detail below.

Manufacturing a tissue web using two TAD fabrics, and particularly two different TAD fabrics, enables the performance of the each of the drying sections to be optimized and the overall drying efficiency to be improved. Further, the TAD fabrics may be selected to provide the resulting tissue web with select physical properties. For example, the first TAD fabric may be selected to impart a topographical pattern onto the web or to impose a large degree of CD strain to the web and the second TAD fabric may be selected to facilitate the rapid and efficient removal of water from the web.

Accordingly, in one embodiment, at least one of the TAD fabrics, and more preferably the first TAD fabric, is selected for molding the web. TAD fabrics suitable for molding include, without limitation, those fabrics which exhibit significant open area or three-dimensional surface contour sufficient to impart greater z-directional deflection of the web. Such fabrics include single-layer, multi-layer, or composite permeable structures. Preferred fabrics have at least some of the following characteristics: (1) On the side of the molding fabric that is in contact with the wet web (the top side), the number of machine direction (MD) strands per inch (mesh) is from 10 to 200 (3.94 to 78.74 per centimeter) and the number of cross-machine direction (CD) strands per inch (count) is also from 10 to 200 (3.94 to 78.74 per centimeter). The strand diameter is typically smaller than 0.050 inch (1.27 mm); (2) On the top side, the distance between the highest point of the MD knuckle and the highest point of the CD knuckle is from about 0.001 to about 0.03 inch (0.025 to about 0.762 mm). In between these two levels, there can be knuckles formed either by MD or CD strands that give the topography a 3-dimensional hill/valley appearance which is imparted to the sheet during the wet molding step; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and, (5) The fabric may be made to show certain geometric patterns that are pleasing to the eye, which typically repeat between every 2 to 50 warp yarns.

In another embodiment at least one of the TAD fabrics, and more preferably the first TAD fabric, is selected for imparting a pattern to the web. Accordingly, in one embodiment, a patterned tissue web is formed during the manufacturing process by depositing the relatively wet web onto a first TAD fabric having a topographical pattern. The topographical pattern may be a line element, which may be either a continuous or a discrete, or it may be a curvilinear decorative element.

In a particularly preferred embodiment at least one of the TAD fabrics, and more preferably the first TAD fabric, comprises a continuous three dimensional element, also referred to simply as a continuous element. Generally the continuous element is disposed on the web-contacting surface of the TAD fabric for cooperating with, and structuring of, the wet fibrous web during manufacturing. In a particularly preferred embodiment the web contacting surface comprises a plurality of spaced apart three dimensional elements distributed across the web-contacting surface and together constituting at least about 15 percent of the web-contacting surface, such as from about 15 to about 35 percent, more preferably from about 18 to about 30 percent, and still more preferably from about 20 to about 25 percent of the web-contacting surface.

In certain embodiments the continuous elements generally extend in the z-direction (generally orthogonal to both the machine direction and cross-machine direction) above the plane of fabric. The elements may have straight sidewalls or tapered sidewalls and be made of any material suitable to withstand the temperatures, pressures, and deformations which occur during the papermaking process. The element width and the height may be varied depending on the desired degree of molding and the resulting tissue product properties. In certain embodiments the height is greater than about 0.5 mm, such as from about 0.5 to about 3.5 mm, more preferably from about 0.5 to about 1.5 mm, and in a particularly preferred embodiment between from about 0.7 to about 1.0 mm. The height is generally measured as the distance between the plane of the fabric and the top plane of the elevations.

Further, the continuous elements may have a width greater than about 0.5 mm, such as from about 0.5 to about 3.5 mm, more preferably from about 0.5 to about 2.5 mm, and in a particularly preferred embodiment between from about 0.7 to about 1.5 mm. The width is generally measured normal to the principal dimension of the elevation within the plane of the fabric at a given location. Where the element has a generally square or rectangular cross-section, the width is generally measured as the distance between the two planar sidewalls that form the element. In those cases where the element does not have planar sidewalls, the width is measured along the base of the element at the point where the element contacts the carrier.

The spacing and arrangement of continuous elements may vary depending on the desired tissue product properties and appearance. In one embodiment a plurality of elements extend continuously throughout one dimension of the fabric and each element in the plurality is spaced apart from adjacent elements. Thus, the elements may be spaced apart across the entire cross-machine direction of the fabric, may endlessly encircle the fabric in the machine direction, or may run diagonally relative to the machine and cross-machine directions. Of course, the directions of the elements alignments (machine direction, cross-machine direction, or diagonal) discussed above refer to the principal alignment of the elements. Within each alignment, the elements may have segments aligned at other directions, but aggregate to yield the particular alignment of the entire elements.

In other embodiments the TAD fabric may be substantially planar having little or no three dimensional surface topography. In one embodiment the TAD fabric is a substantially planar woven fabric such as a multi-layered plain-woven fabric having base warp yarns interwoven with shute yarns in a 1×1 plain weave pattern. One example of a suitable substantially planar woven fabric is disclosed in U.S. Pat. No. 8,141,595, the contents of which are incorporated herein in a manner consistent with the present invention. In a particularly preferred embodiment the second TAD fabric comprises a substantially planar woven fabric wherein the plain-weave load-bearing layer is constructed so that the highest points of both the load-bearing shutes and the load-bearing warps are coplanar and coincident with the plane.

In still other embodiments TAD fabrics having different degrees of air permeability may be provided. For example, the first TAD fabric may have a relatively low degree of permeability, such as less than about 500 CFM and more preferably less than about 400 CFM, such as from about 30 to about 500 CFM and still more preferably from about 50 to about 300 CFM. Because the web is relatively wet within the first dryer section very little, if any, heated air actually passes through the web the first TAD fabrics degree of permeability may be relatively low without impeding drying. Conversely the second TAD fabric may have a relatively high degree of permeability, such as greater than about 300 CFM and more preferably greater than about 500 CFM, such as from about 300 to about 1400 CFM and more preferably from about 500 to about 700 CFM. In a particularly preferred embodiment the first fabric has an air permeability from about 50 to about 400 CFM and the second fabric has an air permeability from about 200 to about 600 CFM, wherein the air permeability of the second fabric is greater than the first. While in certain instances the foregoing ranges of permeability may overlap it is to be understood that in those embodiments where the first and the second TAD fabrics have different air permeability the values will not be the same.

While in certain embodiments it may be advantageous to have first and second TAD fabrics that are different, in other embodiments it may be useful to have first and second TAD fabrics that are substantially similar. Where the first and second TAD fabrics are substantially similar it is preferable that the fabrics comprise at least one MD oriented line element. In such embodiments the first and the second TAD are purposefully misaligned such that the at least one MD oriented line element of the first TAD is not aligned with the at least one MD oriented line element of the second TAD. In this manner the two TADs are substantially identical, but are not registered with one another such that the portion of the tissue web in contact with the MD oriented line element of the first TAD is not in contact with MD oriented line element of the second TAD.

By purposefully misaligning the first and the second TADs the drying performed by the first and the second TADs may be varied. For example, the area of the web which was not sufficiently dried by the first TAD because of lack of airflow resulting from the fabric element may be dried by the second TAD as this area will now be unobscured due to the misalignment of the first and the second TAD fabrics. In other embodiments the temperatures of the TADs may be adjusted to optimize the drying performed by each TAD. For example, where only a relatively small percentage of the TAD fabric comprises line elements, such as less than about 25 percent, it may be useful to operate the second TAD at a lower temperature than the first as only a relatively small amount of the tissue web remains to be dried.

EXAMPLES

The benefits and advantages of utilizing two separate TAD fabrics was explored by manufacturing tissue products using a number of different fabrics. Inventive tissue products were manufactured using a TAD apparatus substantially as illustrated in FIG. 1. The properties of the first and the second TAD fabrics are described in TABLE 1, below. Control samples were manufactured using a conventional TAD apparatus where a single TAD fabric encircled the first and the second TADs. The single TAD fabric used to manufacture the controls was a woven fabric having a topographical pattern with a maximum z-directional elevation differences of 0.74 mm and an air permeability of 445 CFM.

TABLE 1

| TAD Fabric | Topographical Pattern | Maximum Z-directional Elevation Differences (mm) | Air Permeability (CFM) | Construction |
|---|---|---|---|---|
| Control | Yes | 0.74 | 445 | Woven |
| Max | Yes | 0.29 | 500 | Woven |
| Jack | Yes | 0.74 | 445 | Woven |

Transfer of the tissue web from the first TAD fabric to the second TAD fabric was accomplished via an intermediate fabric. The web was initially transferred from the first TAD fabric to an intermediate fabric with the assistance of a vacuum transfer roll. Once transferred to the intermediate fabric the web was sandwiched between the intermediate fabric and the second TAD fabric. The web was then transferred to the second TAD fabric with the assistance of a vacuum transfer roll. All webs were dried to a final dryness of about 98 percent consistency. The consistency of the web exiting the first TAD was targeted at about 60 percent consistency. During manufacture the total gas flow (lbs/min) to the first and the second TAD was measured and the results are reported in TABLE 2, below.

TABLE 2

| Sample | First TAD Fabric | Second TAD Fabric | Total Gas Flow (lbs/min) | Gas Flow Reduction (%) |
|---|---|---|---|---|
| Control | NA | NA | 3.79 | — |
| 1 | Jack | Jack | 2.31 | 39% |
| 2 | Jack | Max | 2.55 | 33% |
| 3 | Max | Jack | 2.47 | 35% |
| 4 | Max | Max | 2.66 | 30% |

The apparatus and methods of manufacturing tissue webs, and in a particularly preferred embodiment through-air dried tissue webs, have been described in detail with respect to the foregoing examples and embodiments thereof. It will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a method of manufacturing a tissue web comprising the steps of depositing an aqueous furnish comprising cellulosic fiber on a foraminous support to form a wet tissue web; transferring the wet tissue web to a first fabric and noncompressively dewatering the wet web to a consistency of from about 40 to about 80 percent to yield a partially dewatered web; transferring the partially dewatered web to second fabric and noncompressively dewatering the partially dewatered web to a consistency from about 60 to about 100 percent.

In a second embodiment the present invention provides the method of the first embodiment wherein the step of noncompressively dewatering the web consists of through-air drying the web and wherein the first and the second fabrics are through-air drying fabrics.

In a third embodiment the present invention provides the method of the first or second embodiments wherein the first and the second fabrics are different.

In a fourth embodiment the present invention provides the method of any one of the first through the third embodiments wherein the first and second fabrics are different and the difference resides in air permeability or surface topography.

In a fifth embodiment the present invention provides the method of any one of the first through the fourth embodiments wherein the step of noncompressively dewatering the wet web to a consistency of from about 40 to about 80 percent is carried out by a first through-air dryer operated at a temperature from about 300° F. to about 400° F. and the step of noncompressively dewatering the partially dewatered web to a consistency from about 60 to about 100 percent is carried out by a second through-air dryer operated at a temperature from about 400° F. to about 500° F., wherein the second through-air dryer is operated at a temperature greater than the first through-air dryer.

In a sixth embodiment the present invention provides the method of any one of the first through the fifth embodiments wherein the first fabric consists of a through-air drying fabric having a z-directional elevation difference of about 0.2 millimeter or greater, such as from about 0.2 to about 3.5 mm and the second fabric consists of a through-air drying fabric having a z-directional elevation difference of about 0.2 millimeter or less.

In a seventh embodiment the present invention provides the method of any one of the first through the sixth embodiments wherein the first fabric consists of a through-air drying fabric having at least one substantially MD oriented line element and the second fabric consists of a through-air drying fabric having at least one substantially MD oriented line element and wherein the substantially MD oriented line element of the first fabric is not aligned with the substantially MD oriented line element of the second fabric.

In an eighth embodiment the present invention provides the method of any one of the first through the seventh embodiments wherein the first fabric consists of a through-air drying fabric having an air permeability from about 50 to about 400 CFM and the second fabric consists of a through-air drying fabric having an air permeability from about 200 to about 600 CFM and wherein the air permeability of the first and the second through-air drying fabrics is different.

What is claimed is:

1. A method of through-air drying a tissue web comprising the steps of transferring a wet tissue web to a first through-air drying fabric and through-air drying the wet web to a consistency of from about 40 to about 80 percent to yield a partially dewatered web; transferring the partially dewatered web to second through-air drying fabric and through-air drying the partially dewatered web to a consistency of from about 60 to about 100 percent.

2. The method of claim 1 wherein the first through-air drying fabric and the second through-air drying fabric are different.

3. The method of claim 1 wherein the first through-air dryer is operated at a temperature from about 300 to about 400° F. and the second through-air dryer is operated at a temperature from about 400 to about 500° F.

4. The method of claim 1 wherein the first through-air drying fabric has surface topography such that there is a z-directional elevation difference of about 0.2 millimeter or greater and the second through-air drying fabric is substantially flat such that the z-directional elevation difference is about 0.2 millimeter or less.

5. The method of claim 1 wherein the first through-air drying fabric comprises at least one substantially MD oriented line element and the second through-air drying fabric comprises at least one substantially MD oriented line element and wherein the substantially MD oriented line element of the first fabric is not aligned with the substantially MD oriented line element of the second fabric.

6. The method of claim 1 wherein the first through-air drying fabric has an air permeability from about 50 to about 400 CFM and the second fabric consists of a through-air drying fabric having an air permeability from about 200 to about 600 CFM.

7. The method of claim 1 further comprising the steps of transferring the partially dried web to an intermediate fabric and transferring the partially dried web from the intermediate fabric to the second through-air drying fabric.

8. The method of claim 1 wherein the partially dewatered web is dried to consistency of at least about 95 percent by the second through-air dryer to yield a dried tissue web and further comprising the steps of winding the dried tissue web into a roll.

9. The method of claim 1 wherein the partially dewatered web is dried to consistency of at least about 60 percent by the second through-air dryer to yield a partially dried tissue web and further comprising the step of adhering the partially dried web to a Yankee dryer and drying the web to a consistency of at least about 95 percent.

10. A method of manufacturing an uncreped through-air dried tissue web comprising the steps of depositing an aqueous furnish comprising cellulosic fiber on a foraminous support to form a wet tissue web; transferring the wet tissue web to a first through-air drying fabric and through-air drying the wet web to a consistency of from about 40 to about 80 percent to yield a partially dewatered web; transferring the partially dewatered web to second through-air drying fabric and through-air drying the partially dewatered web to a consistency greater than about 95 percent.

11. The method of claim 10 wherein the first through-air drying fabric and the second through-air drying fabric are different.

12. The method of claim 10 wherein the first through-air dryer is operated at a temperature from about 300 to about 400° F. and the second through-air dryer is operated at a temperature from about 400 to about 500° F.

13. The method of claim 10 wherein the first through-air drying fabric has surface topography such that there is a z-directional elevation difference of about 0.2 millimeter or greater and the second through-air drying fabric is substantially flat such that the z-directional elevation difference is about 0.2 millimeter or less.

14. The method of claim 10 wherein the first through-air drying fabric comprises at least one substantially MD oriented line element and the second through-air drying fabric comprises at least one substantially MD oriented line element and wherein the substantially MD oriented line element of the first fabric is not aligned with the substantially MD oriented line element of the second fabric.

15. The method of claim 10 wherein the first through-air drying fabric has an air permeability from about 50 to about 400 CFM and the second fabric consists of a through-air drying fabric having an air permeability from about 200 to about 600 CFM.

16. The method of claim 10 further comprising the steps of transferring the partially dried web to an intermediate fabric and transferring the partially dried web from the intermediate fabric to the second through-air drying fabric.

17. A method of manufacturing creped through-air dried tissue web comprising the steps of depositing an aqueous furnish comprising cellulosic fiber on a foraminous support to form a wet tissue web; transferring the wet tissue web to a first through-air drying fabric and through-air drying the wet web to a consistency of from about 40 to about 60 percent to yield a partially dewatered web; transferring the partially dewatered web to second through-air drying fabric and through-air drying the partially dewatered web to a consistency greater than about 60 percent.

18. The method of claim 17 wherein the first through-air drying fabric and the second through-air drying fabric are different.

19. The method of claim 17 wherein the first through-air dryer is operated at a temperature from about 300 to about 400° F. and the second through-air dryer is operated at a temperature from about 400 to about 500° F.

20. The method of claim 17 wherein the first through-air drying fabric has surface topography such that there is a z-directional elevation difference of about 0.2 millimeter or greater and the second through-air drying fabric is substantially flat such that the z-directional elevation difference is about 0.2 millimeter or less.

21. The method of claim 17 wherein the first through-air drying fabric comprises at least one substantially MD oriented line element and the second through-air drying fabric comprises at least one substantially MD oriented line element and wherein the substantially MD oriented line element of the first fabric is not aligned with the substantially MD oriented line element of the second fabric.

22. The method of claim 17 wherein the first through-air drying fabric has an air permeability from about 50 to about 400 CFM and the second fabric consists of a through-air drying fabric having an air permeability from about 200 to about 600 CFM.

* * * * *